US010195616B2

(12) United States Patent
Janzen

(10) Patent No.: US 10,195,616 B2
(45) Date of Patent: Feb. 5, 2019

(54) LABORATORY CENTRIFUGE HAVING INSULATED COMPRESSOR

(71) Applicant: THERMO ELECTRON LED GMBH, Langenselbold (DE)

(72) Inventor: Hans Janzen, Hemmingen (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 14/090,012

(22) Filed: Nov. 26, 2013

(65) Prior Publication Data

US 2014/0349827 A1 Nov. 27, 2014

(30) Foreign Application Priority Data

May 27, 2013 (DE) ..... 20 2013 004 850
Oct. 25, 2013 (DE) ..... 20 2013 009 485

(51) Int. Cl.
*B04B 7/02* (2006.01)
*B04B 15/02* (2006.01)

(52) U.S. Cl.
CPC ..... *B04B 15/02* (2013.01); *B04B 7/02* (2013.01)

(58) Field of Classification Search
CPC ..... B04B 7/02; B04B 15/02
USPC ..... 494/14, 82
See application file for complete search history.

(56) References Cited

U.S. PATENT DOCUMENTS 4,676,473 A * 6/1987 Giles ..... 248/638
4,839,397 A * 6/1989 Lohmar et al. ..... 521/159
5,462,142 A * 10/1995 Handke et al. ..... 188/313
5,965,249 A * 10/1999 Sutton et al. ..... 428/304.4
6,092,997 A * 7/2000 Kimura ..... F04B 27/1036 417/223
6,994,068 B2 * 2/2006 Menzel et al. ..... 123/192.1
7,883,763 B2 * 2/2011 Tinianov ..... 428/201
8,272,834 B2 * 9/2012 Lefevre ..... F04D 29/665 415/119
2011/0293446 A1 * 12/2011 Stupnik ..... F04B 39/121 417/363

FOREIGN PATENT DOCUMENTS

DE 28 16 449 A1 10/1979
EP 2335830 A1 * 6/2011 ..... B04B 15/02
EP 2 335 830 B1 3/2013
JP 08-141438 A 6/1996
JP 2000-107642 A 4/2000
(Continued)

OTHER PUBLICATIONS

JP 2008240574 AIPN Machine Translation.*
(Continued)

*Primary Examiner* — Walter D. Griffin
*Assistant Examiner* — Shuyi S. Liu
(74) *Attorney, Agent, or Firm* — Wood Herron & Evans LLP

(57) ABSTRACT

The present invention relates to a laboratory centrifuge having a cooling device which comprises a compressor enclosed by a compressor housing, with the compressor housing, in the region of the compressor head, being at least regionally provided with a damping material which is capable of absorbing vibrations in the range from 20 Hz to 100 Hz.

11 Claims, 2 Drawing Sheets

(56) References Cited

FOREIGN PATENT DOCUMENTS

JP 2008240574 A * 10/2008

OTHER PUBLICATIONS

EP 2335830 Espacenet Machine Translation.*
Espacenet, English Machine Translation of Application No. DE2816449A1, published Oct. 18, 1979, retrieved from http://worldwide.espacent.com on Nov. 22, 2013 (5 pages).
Japanese Patent Office, English Translation of Patent Abstracts of Japan, Publication No. JP08141438A, published Jun. 4, 1996 (1 page).
Japanese Patent Office, English Machine Translation of JP08-141438A, published Jun. 4, 1996 (2 pages).
Japanese Patent Office, English Translation of Patent Abstracts of Japan, Publication No. 2000107642A, published Apr. 16, 2000 (1 page).
Japanese Patent Office, English Machine Translation of JP2000-107642A, published Apr. 18, 2000, retrieved from http://fachdbsvr01/cgi-bin/java_JPT202.pl?kp=1&nr=2000-107642 on Jun. 4, 2013 (6 pages).

* cited by examiner

LABORATORY CENTRIFUGE HAVING INSULATED COMPRESSOR

CROSS-REFERENCE TO RELATED APPLICATIONS

The present application claims priority under 35 U.S.C. § 119 of German Patent Application Nos. 20 2013 004 850.6, filed May 27, 2013, and 20 2013 009 485.0, filed Oct. 25, 2013, the disclosures of which are hereby incorporated herein by reference in their entireties.

FIELD OF THE INVENTION

The present invention relates to a laboratory centrifuge having a cooling device which comprises a compressor enclosed by a compressor housing.

BACKGROUND OF THE INVENTION

Such laboratory centrifuges are used in chemical, biological, biochemical, or medical laboratories for separating samples which contain substances of different masses. In particular, laboratory centrifuges are used to separate solids from liquids with the aid of the centrifugal force generated during the rotation procedure. High rotational velocities of 20,000 RPM or more are frequently necessary for this purpose. High temperatures may arise during the operation of the centrifuge, which can have harmful effects on the samples. Laboratory centrifuges are therefore often provided with a cooling device, which cools down the rotor compartment having the rotor contained therein, which in turn accommodates the samples, to temperatures which are not harmful for the samples. To generate the low temperatures, the cooling device used typically has a compressor. Laboratory centrifuges having such cooling devices are described, for example, in DE 28 16 449 A1 and EP 2 335 830 B1. In particular if reciprocating piston compressors are used, vibrations are generated, which can result in shocks to the centrifuge and possibly in worsened sample separation. Above all, the generated vibrations cause an increased noise level, which is perceived to be unpleasant by the users.

SUMMARY OF THE INVENTION

The object of the present invention is accordingly to specify a laboratory centrifuge having a cooling device equipped with a compressor which does not have the above-described disadvantages, i.e., in which the vibrations generated by the compressor are attenuated.

In detail, the present invention thus relates to a laboratory centrifuge having a cooling device which comprises a compressor enclosed by a compressor housing. The compressor housing is arranged directly on or around the compressor and in particular does not enclose any components of the centrifuge other than the compressor. The compressor housing is in turn arranged in the centrifuge housing, with the centrifuge housing also including structures in the interior of the centrifuge—for example, intermediate floors or supports—on which individual components of the centrifuge are fastened. The compressor housing is at least regionally provided with a damping material which is capable of absorbing vibrations in the range from 20 Hz to 100 Hz, and in particular in the range from 50 Hz to 60 Hz. The vibrations, which are substantially generated by the compressor of the cooling device, are absorbed and significantly attenuated or even reduced to zero by the damping material with which the compressor housing is provided. Sound thus does not penetrate to the outside, so that no disturbance of the user occurs.

According to the present invention, the damping material is arranged on the compressor housing in the region of the compressor head. This region designates an upper region of the compressor housing—i.e., the region facing away from the footprint of the compressor. Specifically, the head region is understood in particular as the region of the upper third of the compressor, the total height of the compressor (including possibly provided compressor feet) being the distance between the footprint of the compressor and its apex. The damping material does not have to be provided in the entire upper third according to the present invention, but rather can only be arranged in subareas. While a preferred attachment location is above the compressor head, the damping material can also extend to lateral regions of the housing so as to form a cap-like structure on the head of the compressor housing.

Fundamentally, the damping material can be provided on the entire housing surface of the compressor in addition to the head region. However, it is preferable to only attach the damping material regionally to the compressor housing and to leave it out in the lower two thirds of the compressor housing. It is especially preferable to provide 5% to 50% of the surface of the compressor housing with the damping material. More preferably, the damping material does not cover more than 30% of the compressor housing surface, since in this manner it is ensured particularly well that the compressor can discharge the heat it generates during operation to the outside and thus does not overheat. The size of the surface fraction covered with damping material is thus dependent in particular on which vibrations are to be expected during operation of the compressor, which damping properties the used damping material has, and how much heat the compressor generates during its operation. The stronger the damping properties of the damping material used, the smaller the area will typically be which is to be covered with damping material. The stronger the vibrations generated by the compressor, the more compressor surface must be covered with damping material or the stronger the damping properties the damping material must have.

Fundamentally, all materials which can absorb vibrations in the range from 20 Hz to 100 Hz and, in particular between 50 Hz and 60 Hz, are suitable as damping material. These are typically elastic or viscoelastic materials which can absorb and attenuate vibrations because of their deformability. Preferred materials are polymer foams and in particular polyurethane foam here, particularly preferably viscoelastic polyurethane foam. Alternatively, materials made of natural or synthetic rubber can be used. Mixtures of rubber can also be used. Furthermore, known damping films made of plastic or nonwoven materials are suitable, in particular those which are already used as insulation materials in other fields, in particular for noise reduction.

In particular, those damping materials which have a weight per unit volume of 50 $kg/m^3$ to 250 $kg/m^3$ have proven to be suitable. Weights per unit volume of 120 $kg/m^3$ to 180 $kg/m^3$ are preferred. A damping material which is presently particularly preferred is polyurethane foam, in particular viscoelastic polyurethane foam, having a weight per unit volume in the last-mentioned range, wherein in particular the higher weights per unit volume up to 180 $kg/m^3$ are preferred.

The damping material can be arranged on the housing surface of the compressor in any manner. The damping material is particularly expediently glued onto the housing surface of the compressor. However, it can also be sufficient to merely clamp the damping material between the housing surface of the compressor and another surface in the region of the laboratory centrifuge. A combination of various types of fastening is also possible.

If the damping material is clamped between the compressor surface and another surface of the centrifuge, it is preferable to arrange the damping material between the surfaces under pre-tension. It is then possible that the damping material can be either relaxed or also compressed during a movement of the surfaces relative to one another. Fundamentally, any suitable surface of the centrifuge, particularly preferably a housing surface of the centrifuge, comes into consideration as a further surface for clamping the damping material. This can also be an intermediate floor between the motor compartment of the centrifuge and the rotor compartment, for example.

A retaining ring, which encloses a section of the compressor housing, is frequently also used for fastening and supporting the compressor. The retaining ring is typically attached to a stationary region of the centrifuge housing to support the compressor. It is preferable according to the present invention to arrange damping material in the region between the retaining ring and the compressor housing surface. The damping material can be arranged circumferentially around the entire circumference of the compressor housing or only sectionally along the circumference. During operation of the compressor, the damping material absorbs the vibrations of the compressor and thus prevents these vibrations from being transmitted unattenuated to the centrifuge housing. It is also advantageous here to arrange the damping material with pre-tension between the retaining ring and the compressor housing surface. The damping material in the region of the retaining ring can be used alternatively or additionally to the attachment of damping material in other regions of the compressor.

The present invention prevents the transmission of vibrations of the compressor to other regions of the centrifuge in a simple manner, in particular to the centrifuge housing and the rotor containing the samples, and thus reduces the noise disturbance for the user. The separation result of the samples can possibly also be improved. The present invention is fundamentally applicable to any type of laboratory centrifuge having a cooling device and a compressor, i.e., for example, in the case of table centrifuges or floor-standing centrifuges.

BRIEF DESCRIPTION OF THE DRAWINGS

The present invention will be explained in greater detail hereafter on the basis of figures. The figures are solely schematic in nature and are only used to illustrate preferred exemplary embodiments, to which the present invention is not restricted, however. In the figures, identical reference signs designate identical components. In the specific figures.

DETAILED DESCRIPTION OF THE INVENTION

Figure 1:
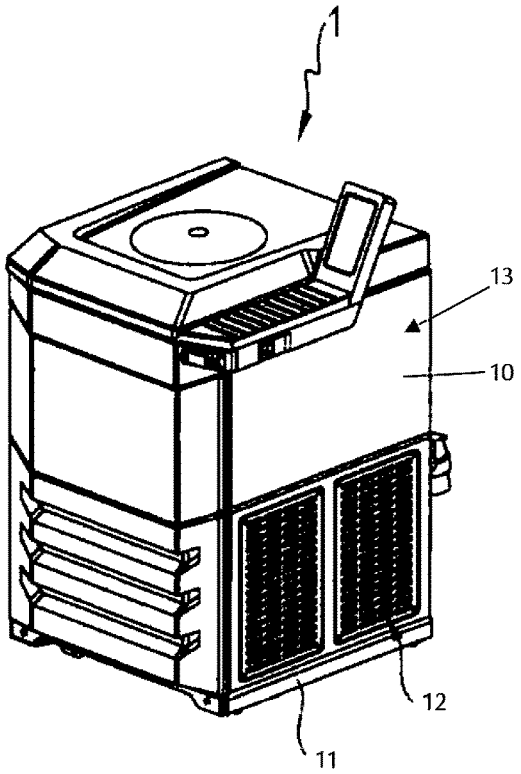
FIG. 1 shows a laboratory centrifuge according to the present invention on the basis of the example of a floor-standing centrifuge in a perspective view.

FIG. 1 shows the view of a laboratory centrifuge 1 according to the present invention on the basis of the example of a floor-standing centrifuge. Except for the damping according to the present invention of the compressor, which is part of the cooling device of the centrifuge 1, the laboratory centrifuge fundamentally corresponds to known prior art centrifuges. A motor and compressor compartment 12 is provided inside the centrifuge housing 10 on the bottom plate 11 and above this, separated from the motor and compressor compartment 12 by an intermediate plate (not visible here), a rotor compartment 13 is provided. The rotor, which is used to accommodate the samples (not visible here), is located in the rotor compartment 13.

Figure 2:
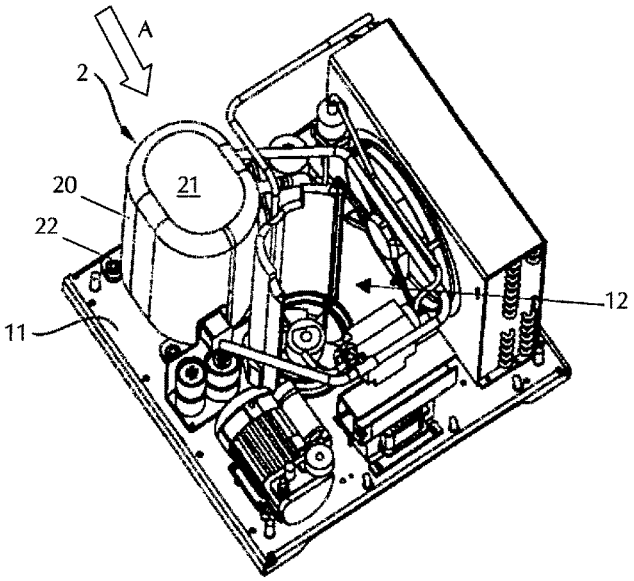
FIG. 2 shows the motor and compressor compartment of the centrifuge according to FIG. 1 in a top view of the bottom plate thereof.

FIG. 2 shows a top view of the bottom plate 11—i.e., into the motor and compressor compartment 12—with housing 10 removed. In addition to components of the laboratory centrifuge such as, for example, a motor, fan, etc., which are known per se and are not designated in greater detail here, a compressor 2 is arranged on the bottom plate 11. This compressor is part of the cooling device of the centrifuge 1 and ensures the cooling of the rotor compartment 13 in a manner also known per se. The compressor 2 is enclosed by a compressor housing 20, which consists of plastic, for example. The view diagonally from above onto the compressor head 21 is shown here. The footprint of the compressor 2, which is remote from the compressor head 21, is arranged on two compressor stands 22, which in turn each stand with two feet on the bottom plate 11. This can be seen in FIG. 3, which illustrates a view of the compressor 2 in the direction of arrow A.

The compressor stands 22 with their feet are to prevent vibrations which arise during operation of the compressor 2 from being transmitted unobstructed to the bottom plate 11 and the centrifuge housing 10 as a whole. Such vibrations fundamentally occur during operation of all types of compressors, i.e., also in the case of rotational compressors, but particularly in the case of reciprocating piston compressors. These vibrations are disadvantageous both for the operation of the centrifuge and also with respect to the noise generation of the centrifuge during its operation. To minimize the noise generation, a damping material 3 is provided in the region of the compressor head 21. This damping material consists of a block of polyurethane foam, in which a recess is provided which can accommodate the compressor head 21 in a formfitting manner. The polyurethane foam has a weight per unit volume of 180 $kg/m^3$, for example. It is arranged such that its top side rests against an intermediate plate 14 which separates the motor and compressor compartment 12 from the rotor compartment 13 as part of the centrifuge housing 10. The damping material 3, i.e., the block of polyurethane foam, is arranged such that it presses against the compressor 2 and the intermediate plate 14 with pre-tension. Vibrations which arise during operation of the compressor are absorbed and attenuated by the damping material 3, and are thus prevented from propagating as noise. In addition, the block of damping material 3 prevents deflection of the centrifuge head 21 and stabilizes the arrangement of the compressor 2 with respect to its longitudinal center axis.

Figure 3:
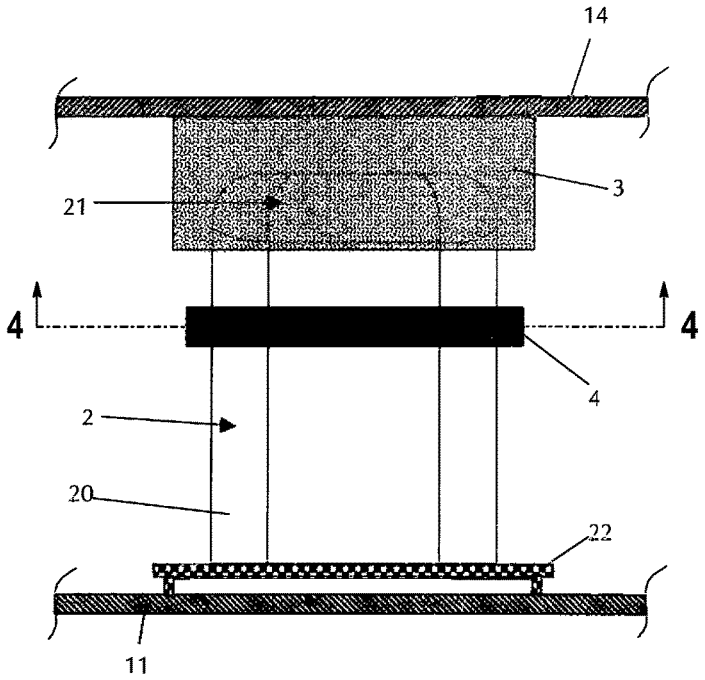
FIG. 3 shows a side view of the compressor arranged on the bottom plate in the direction of arrow A in FIG. 2.
Figure 4:
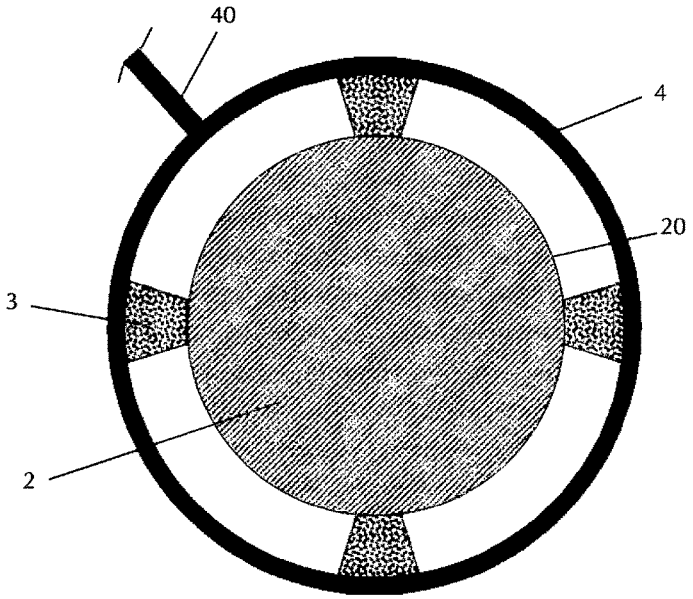
FIG. 4 shows a cross-section along line 4-4 of FIG. 3.

A retaining ring 4, which encloses the compressor housing 20 of the compressor 2, is also used for the same purpose. FIG. 4 shows a cross-section along line B-B of FIG. 3 in the region of the retaining ring 4. For the sake of better illustration, compressor and retaining ring are each shown having round cross-section in FIG. 4, the effect is the same as in the case of an oval cross-section, however.

As can be seen in FIG. 4, an intermediate space is provided between compressor 2 and retaining ring 4, in which four elements made of damping material 3 are provided uniformly spaced apart from one another. These elements can consist of polyurethane foam, like the damping material 3 on the compressor head 21 (FIG. 3). They are also arranged under pre-tension between retaining ring 4 and compressor housing 20. Because of their elastic properties, they absorb vibrations originating from the compressor 2 and thus prevent transmission to the retaining ring and to other parts of the centrifuge housing, on which the retaining ring 4 is fastened via a connection part 40.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A laboratory centrifuge having a cooling device which comprises a compressor having a lower compressor footprint and an upper compressor head located remote from the lower compressor footprint and being enclosed by a compressor housing, wherein in a region of the compressor head located proximate an upper region of the compressor housing, the compressor housing is at least regionally provided with a damping material in engagement with the outside of, and adjacent to, the compressor housing which is capable of absorbing vibrations in the range from 20 Hz to 100 Hz, wherein the damping material comprises an elastic or viscoelastic material having a weight per unit volume of 50 kg/m$^3$ to 250 kg/m$^3$, and further wherein the damping material covers 5% to 50% of the compressor housing surface.

2. The laboratory centrifuge according to claim 1, wherein the damping material is capable of absorbing vibrations in the range from 50 Hz to 60 Hz.

3. The laboratory centrifuge according to claim 1, wherein the damping material is selected from a polymer foam, a damping film made of plastic, a nonwoven material, a natural rubber, a synthetic rubber or mixtures of rubber.

4. The laboratory centrifuge according to claim 3, wherein the damping material is one of a polyurethane foam and a viscoelastic polyurethane foam.

5. The laboratory centrifuge according to claim 1, wherein the damping material has a weight per unit of volume of 120 kg/m$^3$ to 180 kg/m$^3$.

6. The laboratory centrifuge according to claim 1, wherein the damping material covers not more than 30% of the compressor housing surface.

7. The laboratory centrifuge according to claim 1, wherein the damping material is arranged on the compressor head.

8. The laboratory centrifuge according to claim 1, wherein the damping material is arranged between the compressor housing and a region of a centrifuge housing under pre-tension.

9. The laboratory centrifuge according to claim 1, wherein the compressor is fastened via a retaining ring enclosing the compressor housing to another centrifuge component, and damping material is arranged between the retaining ring and the compressor housing.

10. The laboratory centrifuge according to claim 9, wherein the damping material is arranged between the retaining ring and the compressor housing under pre-tension.

11. The laboratory centrifuge according to claim 1, wherein the compressor is a reciprocating piston compressor.

* * * * *